US006044789A

United States Patent [19]

Kurzman

[11] Patent Number: 6,044,789

[45] Date of Patent: Apr. 4, 2000

[54] FABRIC SKINNED INFLATABLE DORY

[76] Inventor: George Kurzman, 1517 San Francisco Ave., Olympia, Wash. 98506

[21] Appl. No.: 09/335,099

[22] Filed: Jun. 17, 1999

[51] Int. Cl.[7] ..... B63B 8/00; B63B 3/00; B63B 1/00; B63B 9/04

[52] U.S. Cl. ..... 114/343; 114/355; 114/63; 441/35

[58] Field of Search ..... 114/347, 352, 114/355, 69, 343, 82, 382, 345, 63; 441/35, 47

[56] References Cited

U.S. PATENT DOCUMENTS

| | | |
|---|---|---|
| 10,266 | 11/1853 | Frazee et al. . |
| 151,400 | 5/1874 | Keeler et al. . |
| 1,038,928 | 9/1912 | Menzel . |
| 2,569,224 | 9/1951 | Brown . |
| 2,697,235 | 12/1954 | Gronli et al. . |
| 3,092,850 | 6/1963 | Klopstock et al. . |

*Primary Examiner*—S. Joseph Morano
*Assistant Examiner*—Patrick Craig Muldoon
*Attorney, Agent, or Firm*—Brian J. Coyne

[57] ABSTRACT

A rigid, inflatable dory and method for constructing the same. A pre-hull is constructed by attaching to a front end of a rigid, substantially, flat bottom a forwardly inclined stempost and, to a rear end thereof, a rearwardly inclined sternpost, and by attaching left and right garboard plank blanks to the sides of the bottom and to the sides of the stempost and sternpost. The stempost and sternpost are forced toward one another to impart camber and flare to the garboard plank blanks, as by connecting them by a taut rope, thereby converting the blanks into garboard planks. A hull frame is then constructed on the pre-hull, comprising longitudinally spaced apart ribs and laterally spaced apart stringers. A gunwale is attached to an upper edge of each side of the hull frame. An inflatable sponson is mounted exteriorly on each side of the hull. For covering each side of the hull, a water-impervious fabric covering has a lower portion attached to the hull adjacent a garboard plank, an intermediate portion wrapped around a sponson, and an upper portion attached to the hull frame adjacent a gunwale. The method facilitates custom design of dorys as the method requires no plug or jig for forming a hull. The dory is light weight, and the sponsons yield enhanced buoyancy and stability in water, and reduced chance of impact damage to other boats.

13 Claims, 4 Drawing Sheets

FABRIC SKINNED INFLATABLE DORY

CROSS REFERENCE TO RELATED APPLICATIONS

None

STATEMENT REGARDING FEDERALLY APPROVED RESEARCH OR DEVELOPMENT

Not Applicable

BACKGROUND OF THE INVENTION

1. Field of the Invention

This invention relates to small boats and methods for the assembly thereof. The present invention relates particularly to a dory having a fabric skinned wooden frame and inflatable sponsons, and a method for constructing the same.

2. Background Art

It is desirable to be able to custom build a small, flatbottom boat or dory to fit the particular size and shape available for storing it aboard a yacht. In the prior art, construction of small, wooden-frame boats has typically proceeded by first constructing a male plug in the size and shape of the desired boat. The plug was then inverted and construction of the boat proceeded by building a wooden frame about the plug, the wooden ribs and stringers for the boat hull being steamed and bent to conform to the shape of the plug. Once a plug had been created, it could be used numerous times to build identical copies of the boat. Alternatively, the hulls of small boats have been built on hull jigs; see, for example, the methods of boat construction disclosed in U.S. Pat. No. 3,092,850 to Klopfstock, et al., and U.S. Pat. No. 2,697,235 to Gronli et al. These methods of construction suffered from the disadvantage that, if a boat of a different size or shape was to be built, a new plug or jig had to be created, which entailed time and expense.

The method of the present invention dispenses with plugs and jigs. Instead, a basket weave type, wooden hull frame, comprising lateral ribs and longitudinal stringers, extends from a stempost to a sternpost, and is assembled over a flat bottom. The wooden frame and is cradled by left and right garboards and by left and right gunwales that also extend from stempost to sternpost. A longitudinally-extended, inflatable sponson is mounted to each of the left and right sides of the hull frame. A water-impervious fabric skin is attached to the frame near the bottom and is wrapped around each sponson. The sponsons provide enhanced buoyancy and stability in water, absorb wave energy, and reduce the chance of impact damage to other boats. These advantages of sponsons combined with the flexibility of a basket-weave type, flexible hull frame, mean greater durability and longer useful life for a dory. Moreover, wrapping the sponsons with water-impervious coverings permits the dory to remain afloat for a time even if a sponson is punctured.

Sponsons have previously been incorporated into small boats. Frazee, U.S. Pat. No. 10,266, for example, disclosed a life boat having left and right, hour-glass-shaped sponsons, and a centrally disposed sponson, all joined by a frame; and Keeler, et al. U.S. Pat. No. 151,400, disclosed a life boat having chambers along the gunwales, secured in place by metallic fenders and an outrigger. Prior to my invention, however, a pair of sponsons have never been incorporated into a small boat by surrounding each of them by a water-impervious covering having a lower portion attached to the hull and an upper portion attached to the hull near a gunwale.

SUMMARY OF THE INVENTION

In a first aspect of the invention, a rigid, inflatable dory is provided that combines a hull, comprising a basket weave type hull frame and a flat bottom attached to a stempost and sternpost, with inflatable sponsons, by wrapping the hull frame and sponsons with water-impervious fabric coverings. This combination provides several advantages: portable, light weight; enhanced buoyancy and stability in water; reduced risk of causing or incurring damage in the event of a collision with other water craft; safe transport through shallow waters; and easy beachability. In a second aspect of the invention, a method is provided for making such a rigid, inflatable dory in a manner that dispenses with the necessity for a plug or jig, and that facilitates custom design and assembly of a dory of a desired size and shape.

The hull extends longitudinally from the stem to the stern of the dory. The hull includes a bottom, left and right garboard planks oppositely and symmetrically disposed about a longitudinal axis defined by front and rear ends of the bottom; an upstanding, rearwardly canted, sternpost attached to a rear end of the bottom and having lower left and ride side portions attached to the left and right garboard planks, respectively; an upstanding, forwardly canted, stempost attached to a front end of the bottom and having lower left and right side portions attached to the left and right garboard planks, respectively; and a flexible hull frame that extends from stempost to sternpost. All exposed surfaces of the bottom and the garboard planks are provided with a water-impervious coating, preferably fiberglass.

The bottom is rigid, longitudinally-elongated, and substantially flat. The bottom has a forwardly and inwardly tapered front portion terminating in a front end, and a rearwardly and inwardly tapered rear portion terminating in a rear end. The front and rear portions of the bottom are joined by a relatively wide central portion. The front, central and rear portions of the bottom define continuous left and right side edges of the bottom.

The flexible hull frame extends from stem to stern. It includes a plurality of longitudinally spaced-apart, convexly bowed, lateral ribs, each rib being symmetrically disposed about the longitudinal axis and having lower convex edges in mating engagement with, and attached to, inner surfaces of the garboard planks. The hull frame also includes a plurality of laterally spaced-apart stringers. Each of the stringers extends from the stempost to the sternpost and is curved for mating engagement with, and attachment to, an outside surface of each of the ribs. A pair of oppositely and symmetrically disposed gunwales extend from stempost to sternpost along the left and right, upper edges of the hull. The ribs and stringers are preferably made of wood, most preferably locust wood.

A pair of longitudinally-extended, inflatable sponsons are mounted to opposite sides of the hull. A water-impervious fabric covering is attached to a lower portion of each side of the hull, stem to stern, wrapped around a sponson, and attached to the nearest gunwale. Preferably, each covering is nylon fabric coated with urethane. Each sponson has an air valve that is drawn through the hull frame to the interior of the dory for convenient inflation and deflation of the sponson. A seat is mounted to the dory over the interior of the hull, and an oar lock is attached to a central portion of each gunwale.

In a second aspect of the invention, a method is provided for constructing a rigid, inflatable dory. A longitudinally-extended, substantially, flat bottom is cut from wood panel to create relatively narrow front and rear end portions joined by a relatively wide central portion. A stempost and a sternpost are cut from wood panel such that each has a substantially horizontal, relatively broad top edge and a relatively narrow bottom edge joined by side edges. A pair of equal-length, longitudinally-extended, garboard plank blanks are cut from wood panel. Garboard planks are formed from the blanks by placing them adjacent to the side edges of the bottom and bending them to conform thereto. The sternpost is placed, upstanding and rearwardly canted, at the rear end of the bottom and lower portions of the sternpost are attached to a rear end portion of each of the garboard planks. The stempost is positioned, upstanding and forwardly canted, at a front end of the bottom, and then attached to front portions of the garboard planks. These attachments are preferably made with staples and wood glue. This completes assembly of the hull pre-frame. The hull pre-frame is then tensioned, stem to stern, to impart camber and flare to the garboard planks, for example, by placing a wood clamp on a top edge of the stempost and of the sternpost and joining the clamps by a taut rope for long enough to cure the wood glue.

For assembling a basket weave type hull frame, a plurality of lateral ribs and longitudinal stringers are prepared. The ribs are longitudinally spaced apart and disposed laterally within the interior of the hull pre-frame. Each rib is bent to conform to the shape of the interior of the hull pre-frame, and attached to inside surfaces of the garboard planks. The longitudinal stringers are laterally spaced apart, attached to the stempost and sternpost, and attached to exterior surfaces of the ribs, preferably by nylon cord lashings.

A longitudinally-extended, inflatable sponson is mounted to each side of the hull frame, and the air valve of each is pulled through the hull frame into the interior of the dory. A fabric covering, preferably nylon fabric, extending from stempost to sternpost, is attached to a lower portion of the hull frame, wrapped around each sponson, and attached to the nearest gunwale. The coverings are then shrunk to remove wrinkles, preferably by applying hot air, and a water-impervious coating is applied thereto, preferably urethane. A seat and oar locks are then installed.

Figure 1:
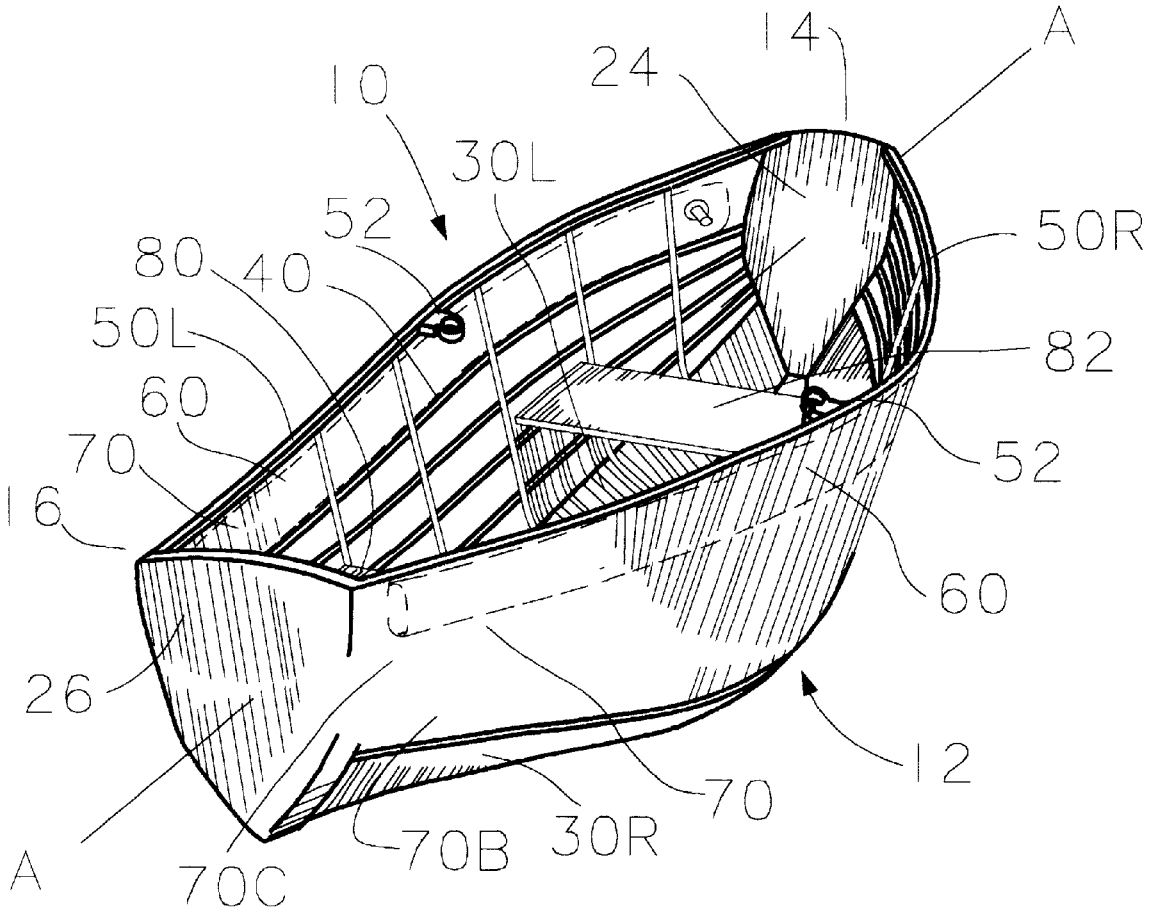
FIG. 1 is a perspective view of a rigid, inflatable dory constructed according to the method of the invention.

The terms "front" and "rear" refer to the right and left portions of the dory as depicted in FIG. 1, corresponding to the stem and the stern of the dory, respectively.

DETAILED DESCRIPTION OF THE PREFERRED EMBODIMENT

Referring now to FIG. 1, an inflatable dory constructed according to the method of the invention is shown, and denoted generally by the numeral 10. The dory 10 has a hull 12 that extends longitudinally from stem 14 to stern 16. The hull 12 includes a rigid, longitudinally-elongated, substantially flat bottom 18. The bottom 18 has a forwardly and inwardly tapered front portion 18F terminating in a front end 19, and a rearwardly and inwardly tapered rear portion 18R terminating in a rear end 20, as may best be seen in FIG. 2. The front portion 18F and the rear portion 18R are joined by a relatively wide central portion 18C, which together define continuous left and right side edges 21, 22, respectively. An upstanding, forwardly canted, sternpost 24 is attached to the front end 19, and an upstanding, rearwardly canted, sternpost 26 is attached to the rear end 20, thereby defining a longitudinal axis A—A. The sternpost 24 and stempost 26 are each in the shape of a shield, having a relatively wide, substantially horizontal top edge 24T, 26T, and inwardly tapered side edges 24S, 26S that terminate in a relatively narrow bottom edge 24B, 26B, respectively. The left and right garboard planks 30L, 30R, are disposed oppositely and symmetrically about axis A—A and extend from stem 14 to stern 16. The garboard planks 30L, 30R are attached to the sides 24S of the stempost 24 and to the sides 26S of the sternpost 26 and are in mating engagement with bottom edges 21, 22.

The hull 12 further includes a flexible hull frame, denoted generally by the numeral 40, comprising a plurality of longitudinally spaced-apart, convexly bowed, lateral ribs 42. Each rib 42 is symmetrically disposed about the axis A—A and has lower, convex edges 42E in mating engagement with, and attached to, inner surfaces 43 of the garboard planks 30R, 30L. The hull frame 40 also includes a plurality of laterally and vertically spaced-apart stringers 44 disposed on opposite sides of the bottom 18. Each of the stringers 44 extends from stem 14 to stern 16 and is curved for mating engagement with, and attachment to, an outside surface of each of the ribs 42. A pair of oppositely and symmetrically disposed gunwales 50L, 50R, extend from stem 14 to stern 16 along the left and right upper edges of the hull 12 and carry centrally disposed oar locks 52.

Longitudinally-elongated, inflatable sponsons 60, depicted in phantom outline in FIG. 1, are mounted exteriorly to opposite sides of the hull 12. Each sponson 60 has an air valve 61 that extends through the hull frame 40 into the interior of the dory 10 for inflating and deflating the sponson 60. When inflated, each sponson 60 assumes substantially the shape of a hollow cylinder, closed at each end. A pair of water-impervious coverings 70 extend from stem 14 to stern 16 on opposite sides of the hull 12 and fully enclose the sponsons 60. Each covering 70 has a bottom portion 70B attached to the hull 12 adjacent a garboard plank 30R, 30L, an intermediate portion 70C above the bottom portion 70B and wrapped around a sponson 60, and an upper portion 70U attached to the hull 12 adjacent a gunwale 50R, 50L. Preferably, each covering 70 is nylon fabric coated with urethane. The bottom 18, garboard planks 30L, 30R, stempost 24, sternpost 26, gunwales 50R, 50L, ribs 42, and stringers 44 are preferably cut out of wood panel to form their respective blanks, ready for shaping and bending them to fit. The most preferred wood for this purpose is locust. All exposed surfaces of the bottom and of the garboard planks are made water-impervious, preferably by coating them with fiberglass. A seat 80 is mounted to the dory 10 over an interior portion of the hull 12, as may best be seen in FIG. 80. A flat cargo platform 82 is installed in the stern end of the dory 10, adjacent the bottom 18, for carrying stowables. The seat 80 and the platform 82 are also cut out of wood panel.

Figure 2:
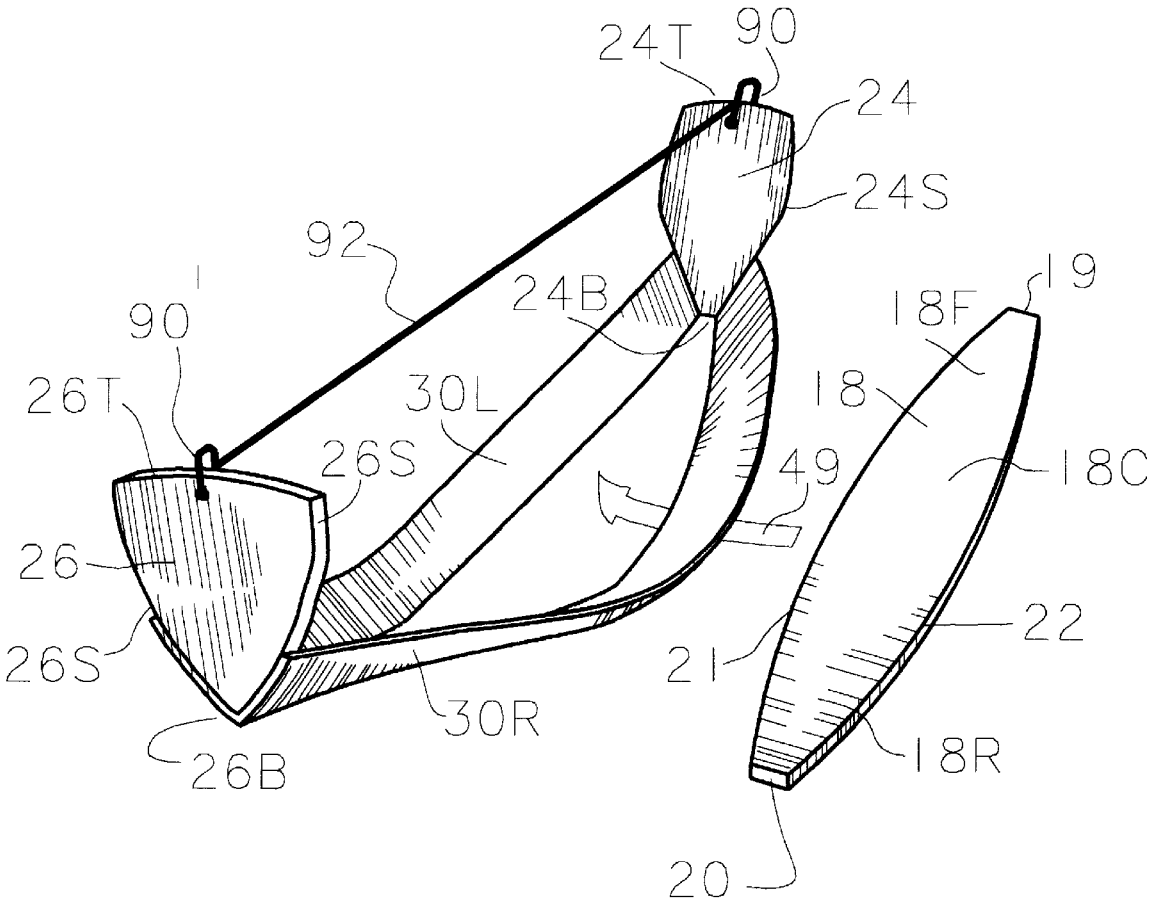
FIG. 2 is a perspective view of a stage in the construction of the pre-frame thereof.
Figure 3:
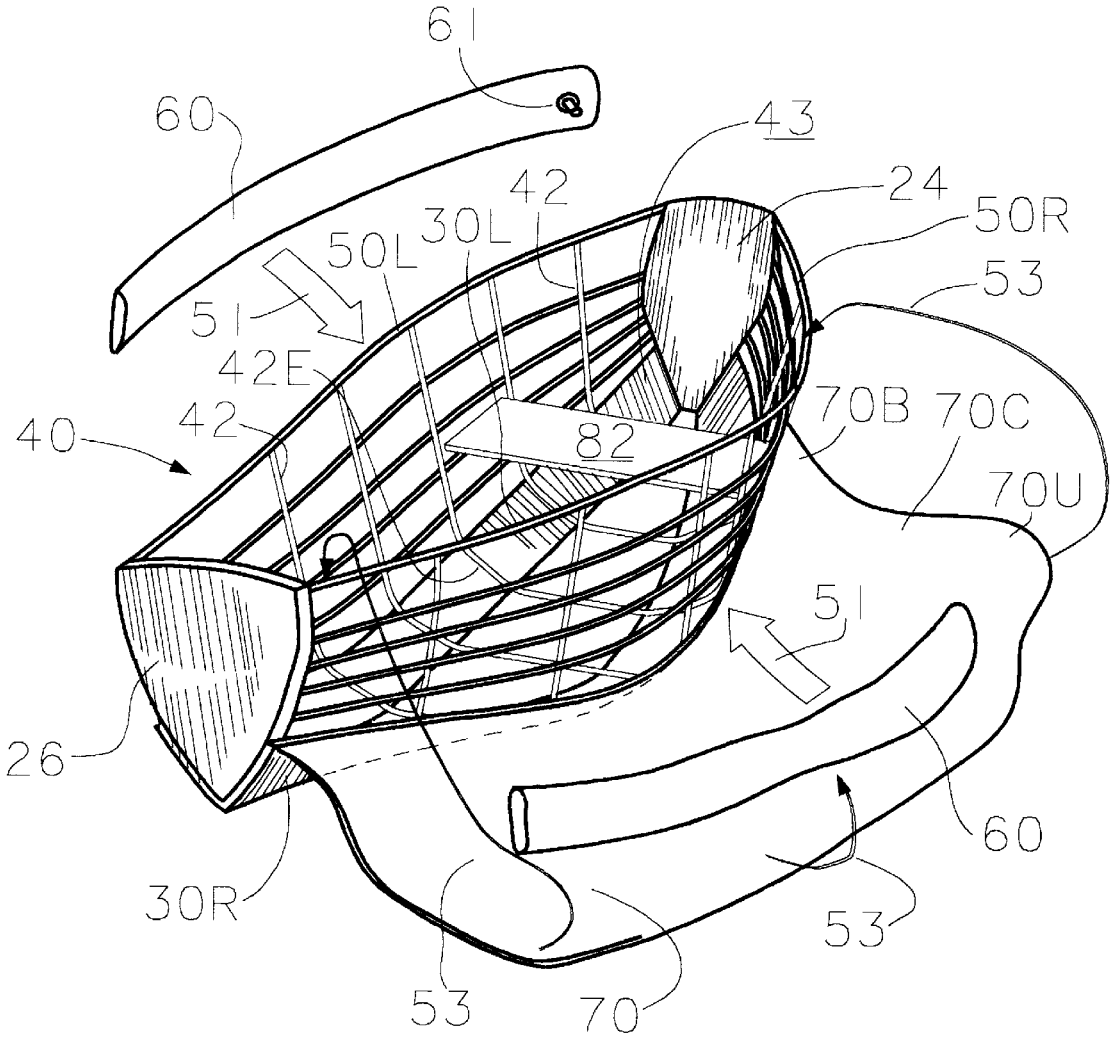
FIG. 3 is a perspective view of a later stage in the construction thereof.
Figure 4:
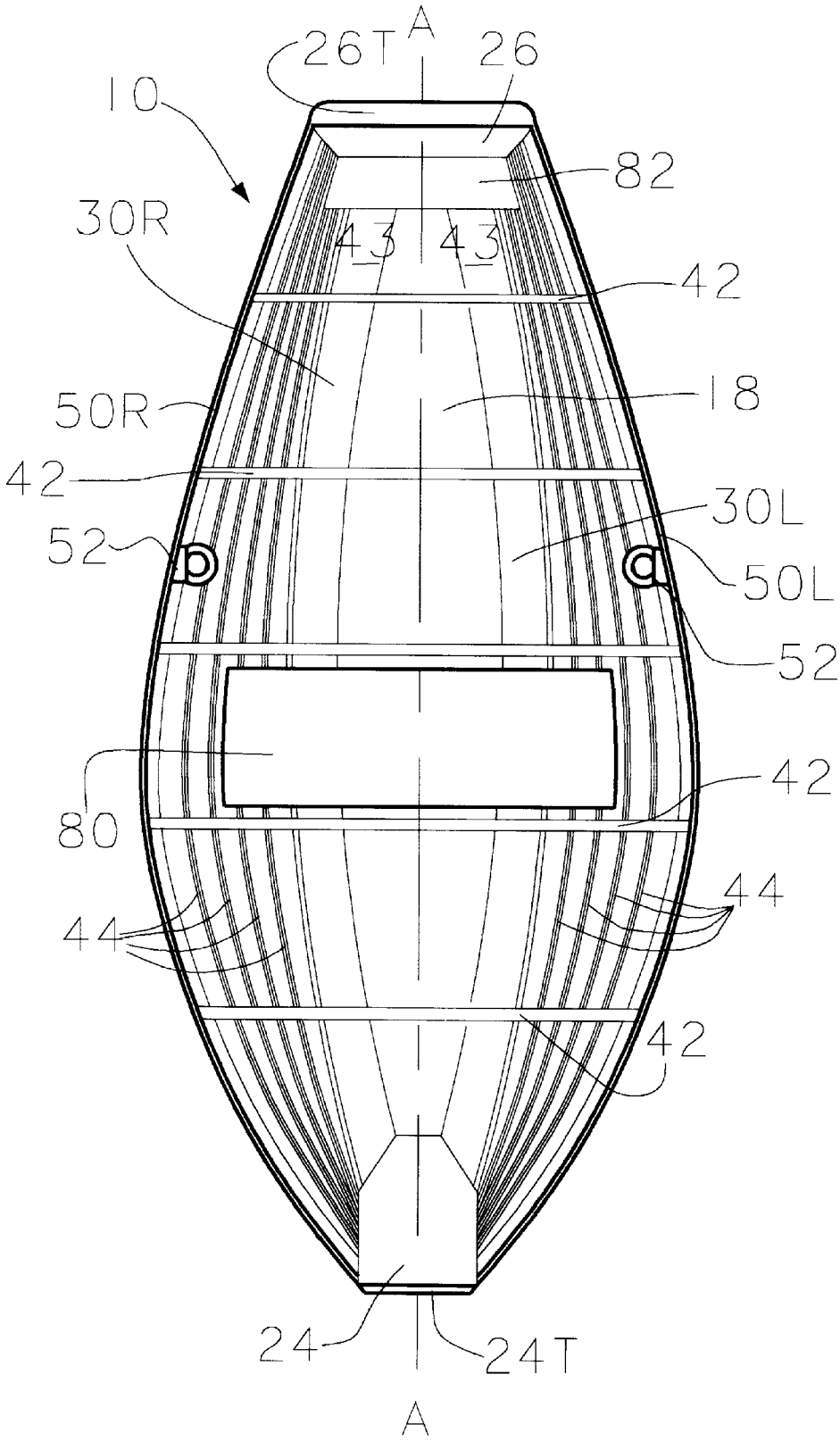
FIG. 4 is a top plan view thereof.

Once the above-described wooden parts of the dory 10 have been cut out of wood panel, the method of construction proceeds as follows. Referring to FIG. 2, a lower portion of the stempost 24 is attached to a front edge of the bottom 18 (arrow 49) and to front portions of the left and right garboard plank blanks 30L, 30R, the stempost 24 being forwardly canted. Similarly, a lower portion of the stempost 26 is attached to a rear edge of the bottom 18 and to rear portions of the left and right garboard plank blanks 30L, 30R. This combination constitutes the hull pre-frame. One way to accomplish the required tensioning is depicted in FIG. 2. A first wood clamp 90 is attached to the top 24T of the stempost 24 and a second wood clamp 90' is attached to the top 26T of the sternpost 26. Opposite ends of a rope 92 are attached to the clamps 90, 90' and drawn taught, thereby imparting flare and camber to the garboard plank blanks, converting them into garboard planks 50R, 50L. All exposed surfaces of the bottom 18 and of the garboard planks 50R, 50L are then made water impervious—preferably by coating with fiberglass. Rib blanks are then bent to form a plurality of convex ribs 42 for mating engagement, in longitudinally-spaced relation, with the garboard planks 50R, 50L, and attached to the garboard planks 50R 50L, and to an upper surface of the bottom 18. Stringer blanks are then bent to form a plurality of convex stringers 44 and placed in laterally and vertically spaced relation within the hull pre-frame, and attached to exterior surfaces of the ribs 42 and to the lower left and right sides of the stempost 24 and the sternpost 26. All intersections of the ribs 42 and stringers 44 are lashed, preferably with nylon cord (not shown), which enhances the flexibility of the hull frame 40. A pair of gunwale blanks are bend to form left and right gunwales 50R, 50L, and attached to upper edges of the left and right sides of the hull frame 40. A deflated, inflatable sponson is mounted (arrow 51) on each of the opposite sides of the hull frame 40, and the air valve 61 of each is pulled through the hull frame 40 and into an interior portion thereof. Two identical pieces of nylon fabric 70 are cut to a length and width corresponding to the size of the left and right sides of the hull frame 40 to form a left and right fabric covering for said sides. A bottom end portion 70B of each fabric 70 is attached to each of the left and right sides of the hull frame 40 adjacent the garboard planks 50L, 50R, respectively. An intermediate portion 70C of each covering 70 is wrapped around the sponson 60 on each side of the hull frame 40, and an upper portion 70U is draped over the adjacent gunwale 50R, 50L and attached thereto (arrow 53). The sponsons 60 are inflated and the fabric coverings 79 are shrunk to eliminate wrinkles therein and make smooth the exterior surface of the hull 12. A preferred method of shrinking the coverings 70 is by directing heated air at them. Next the seat 80, storage platform 82, and oar locks 52 are installed. A water-impervious coating is then applied to the coverings 70, preferably urethane.

It will be appreciated that various modifications can be made to the exact form of the present invention without departing from the scope thereof. It is accordingly intended that the disclosure be taken as illustrative only and not limiting in scope, and that the scope of the invention be defined by the following claims.

I claim:

1. A rigid, inflatable dory, comprising:

(a) a hull, said hull extending longitudinally from the stem to the stern of the dory and including (1) a rigid, longitudinally-elongated, substantially flat bottom having a forwardly and inwardly tapered front portion terminating in a front end and a rearwardly and inwardly tapered rear portion terminating in a rear end, said front and rear portions being joined by a relatively wide central portion, and said front, central and rear portions defining continuous left and right side edges;

(2) left and right garboard planks oppositely and symmetrically disposed about a longitudinal axis defined by the front and rear ends of said bottom, said garboard planks extending from stem to stern and curved for mating engagement with the side edges of the bottom;

(3) an upstanding, rearwardly canted, sternpost attached to a rear end of said bottom and having lower left and right side portions attached to the left and right garboard planks, respectively;

(4) an upstanding, forwardly canted, stempost attached to a front end of said bottom and having lower left and right side portions attached to the left and right garboard planks, respectively; and (5) a flexible hull frame, extending from stem to stern, and including (i) a plurality of longitudinally spaced-apart, convexly bowed, lateral ribs, each rib being symmetrically disposed about the longitudinal axis and having lower convex edges in mating engagement with, and attached to, inner surfaces of the garboard planks; and (ii) a plurality of laterally spaced-apart stringers, each of said stringers extending from stem to stern and curved for mating engagement with, and attachment to, an outside surface of each of said ribs;

(b) a pair of oppositely and symmetrically disposed gunwales extending from stem to stern along the left and right, upper edges of the hull;

(c) a pair of longitudinally-extended, inflatable sponsons mounted to opposite sides of the hull;

(d) a pair of water-impervious coverings, each of said coverings having a bottom portion attached to the hull adjacent a garboard plank, an intermediate portion wrapped around a sponson, and an upper portion attached to the hull adjacent a gunwale; and (e) a seat mounted to the dory over an interior portion of the hull.

2. The dory of claim 1, wherein the coverings are urethane-coated fabric.

3. The dory of claim 1, wherein each of the sponsons has an air valve that extends to an interior portion of the dory through the frame, whereby the valve stem of each air valve is accessible from within said interior portion for inflating and deflating the sponsons.

4. The dory of claim 3, wherein the stringers and ribs are made from wood and bent to the required shapes.

5. A method for making a fabric-skinned, rigid, inflatable dory, comprising the steps of:

(a) creating a hull frame by the acts of (1) cutting from wood panel a longitudinally-extended, substantially flat, rigid bottom having a forwardly and inwardly tapered front portion terminating in a front end and a rearwardly and inwardly tapered rear portion terminating in a rear end, said front and rear portions being joined by a relatively wide central portion, and said front, central and front portions defining continuous left and right side edges;

(2) cutting from wood panel a stempost having a substantially horizontal, relatively broad top edge, and inwardly and downwardly tapered opposite side edges terminating in a relatively narrow bottom edge;

(3) cutting from wood panel a sternpost having a substantially horizontal top edge, and inwardly and downwardly tapered opposite side edges terminating in a relatively narrow, bottom edge;

(4) cutting from wood panel a longitudinally-extended left garboard plank blank and an identical right garboard plank blank;

(5) bending the left and right garboard plank blanks to form garboard planks for mating engagement with the left and right lower sides of the stempost and sternpost, and for mating engagement with the left and right sides of the bottom, respectively;

(6) attaching a lower portion of the sternpost in upstanding, rearwardly canted orientation, to a rear end portion of each of the garboard planks;

(7) attaching a lower portion of the stempost in upstanding, forwardly canted orientation, to a front end portion of each of the garboard planks, thereby forming a hull pre-frame;

(8) tensioning the hull pre-frame to create camber and flare in the garboard planks;

(9) inserting the bottom between lower edges of the garboard planks, stempost and sternpost;

(10) cutting from wood panel a plurality of rib blanks;

(11) bending the rib blanks to form a plurality of convex ribs for mating engagement, in longitudinally-spaced relation, with the garboard planks;

(12) attaching the ribs in longitudinally-spaced relation to the garboard planks and to an upper surface of the bottom;

(13) cutting from wood panel a plurality of elongated stringer blanks;

(14) bending the stringer blanks to form a plurality of convex stringers for mating engagement, in laterally-spaced relation, with exterior surfaces of the ribs and with lower left and right sides of the stempost and sternpost;

(b) cutting identical left and right gunwale blanks;

(c) bending each gunwale blank to form left and right gunwales for mating engagement with the upper edges of the left and right sides of the hull frame;

(d) attaching the left and right gunwales to the left and right sides of the hull frame, respectively;

(e) cutting two longitudinally-elongated pieces of fabric to a length and width corresponding to the size of the left and right sides of the hull frame to form a left and right fabric covering for said sides;

(f) attaching, from stempost to sternpost, and in a water tight manner, a bottom end portion of the left and right coverings to the left and right sides of the hull frame adjacent the garboard planks, respectively;

(h) wrapping an intermediate portion of the left and right coverings around left and right inflatable sponsons and attaching an upper portion of said coverings to the left and right gunwales, respectively;

(i) inflating the sponsons;

(i) shrinking the fabric coverings to eliminate wrinkles and therein and make smooth the exterior surface of the hull; and (j) applying a water-impervious coating to the coverings.

6. The method of claim 5, wherein tensioning the hull pre-frame to create camber and flare in the garboard planks is accomplished by the acts of:

(a) attaching a first wood clamp to an upper portion of the sternpost and a second wood clamp to an upper portion of the stempost; and (b) connecting the first wood clamp to the second wood clamp with a taught rope.

7. The method of claim 6, wherein the garboard planks and the gunwales are attached to the stempost and to the sternpost by wood glue and staples.

8. The method of claim 5, wherein shrinking the fabric coverings is accomplished by heating them.

9. The method of claim 5, wherein the wood panel is locust wood.

10. The method of claims 5, 6, 7, 8, or 9, wherein the fabric coverings are nylon fabric and the fabric coating is urethane.

11. The method of claim 10, further comprising applying a fiberglass coating to all exposed surfaces of the bottom and to all exposed surfaces of the garboard planks.

12. The method of claim 11, further comprising attaching an oar lock to a central portion of each of the gunwales.

13. The method of claim 12, further comprising mounting a seat to the dory over an interior portion of the hull.

* * * * *